US007192121B2

(12) United States Patent
Barbet et al.

(10) Patent No.: US 7,192,121 B2
(45) Date of Patent: Mar. 20, 2007

(54) INKJET PRINTER

(75) Inventors: Bruno Barbet, Etoile (FR); Pierre Henon, Valence (FR)

(73) Assignee: Imaje SA, Bourg les Valence (FR)

( * ) Notice: Subject to any disclaimer, the term of this patent is extended or adjusted under 35 U.S.C. 154(b) by 0 days.

(21) Appl. No.: 10/545,955

(22) PCT Filed: Feb. 24, 2004

(86) PCT No.: PCT/FR2004/050077

§ 371 (c)(1),
(2), (4) Date: Aug. 17, 2005

(87) PCT Pub. No.: WO2005/070676

PCT Pub. Date: Aug. 4, 2005

(65) Prior Publication Data

US 2006/0139408 A1 Jun. 29, 2006

(30) Foreign Application Priority Data

Feb. 25, 2003 (FR) ..... 03 02272

(51) Int. Cl.
*B41J 2/06* (2006.01)

(52) U.S. Cl. ..... 347/55

(58) Field of Classification Search ..... 347/55, 347/74–77

See application file for complete search history.

(56) References Cited

U.S. PATENT DOCUMENTS 3,596,275 A 7/1971 Sweet
3,878,519 A 4/1975 Eaton
4,027,308 A * 5/1977 Fan et al. ..... 347/75
4,220,958 A 9/1980 Crowley
4,321,609 A * 3/1982 Fidler et al. ..... 347/77
4,638,328 A 1/1987 Drake et al.
4,746,928 A * 5/1988 Yamada et al. ..... 347/75
4,845,512 A * 7/1989 Arway ..... 347/77
6,109,739 A * 8/2000 Stamer et al. ..... 347/73

FOREIGN PATENT DOCUMENTS

EP 949 077 10/1999
EP 1 092 542 4/2001
FR 2 471 278 6/1981

OTHER PUBLICATIONS

Donald J. Drake, "Binary continuous thermal ink jet break off length modulation", Xerox Disclosure Journal, vol. 14, No. 3, pp. 95-100 1989.

* cited by examiner

*Primary Examiner*—An H. Do
(74) *Attorney, Agent, or Firm*—Oblon, Spivak, McClelland, Maier & Neustadt, P.C.

(57) ABSTRACT

A printer head of an ink jet printer is provided with an internal stimulation system with which it is possible to create in an upstream breaking position of a jet, an upstream break-up forming in a zero potential area, drops which will be used for printing, and jet sections on the one hand and in a downstream breaking position, a break-up of the jet or of sections of the jet forming in a non-zero potential area, drops which are recovered on the other hand. A sorting system common to all the jets of the head provides simplification of the head and reduction of its bulkiness.

31 Claims, 5 Drawing Sheets

INKJET PRINTER

TECHNICAL FIELD

The invention is located in the field of printer heads and of continuous ink jet printers. It also relates to a method for selectively projecting portions of a conducting ink jet and notably to a continuous ink jet printing method. The method and the printer according to the present invention may be used in all industrial fields related to writing, notably to marking, coding, addressing, customization and decoration of industrial products.

STATE OF THE PRIOR ART

The typical operation of a continuous jet printer may be described as follows. Electrically conducting ink maintained under pressure escapes from a calibrated nozzle. Under the action of a periodic stimulation device, the thereby formed ink jet is broken at regular time intervals at a unique space location. Downstream from the position of the break of the jet, the continuous jet is transformed into a train of identical and regularly spaced out ink drops. A first group of electrodes, the usually recognized function of which is to selectively transfer a predetermined amount of electric charge to each drop of the jet, is placed in the vicinity of the break position.

The set of thereby selectively charged drops then crosses a second layout of electrodes within which a constant electric field prevails, which will change the trajectory of the charged drops.

In a first alternative so-called deviated continuous jet printer the amount of charge transferred to the drops of the jet is variable depending on the value of an electrical potential applied to a charging electrode located in a formation area of the drops. The potential applied to the charging electrode is determined according to the write command. This potential matches the intended destination of the drop on the substrate or in a recovery trough if the drop is not intended for printing, for the drop which will pass into the electric field determined by the potential of the charging electrodes. Another way for changing the value of the electric charge allocated to each drop is described in Patent Application FR 2471278 corresponding to the U.S. Pat. No. 4,346,387, consists of creating a charging electric field for example increasing in an axial direction of the jet and of controlling the formation point of the drops so that the potential of the breaking point, as in the previous case, matches the intended destination of the drop on the substrate or in a recovery trough if the drop is not intended for printing. Each drop upon passing into the second arrangement of electrodes with a constant field, experiences a deflection which increases with the electric charge which was previously allocated to it and is found directed towards a specific point of the printing medium or towards the recovery trough. With this technology, by its multiple deflection levels, a unique nozzle may print, by segment or frame, a line of points of a given height, the entirety of a pattern. Passing from one segment to the other is performed by continuous displacement, perpendicularly to said segment, of the substrate relatively to the printing head.

The second alternative is that of the binary continuous jet. This technique mainly differs from the previous one by the fact that the charge level of the drops is binary. Upon passing through the deflection electrodes, drops are either uniformly deviated or not deviated according to the charge which they have received. The printing of characters or patterns therefore generally requires the use of multi-nozzle printing heads, the center distance of the ports coinciding with that of the impacts on the printing medium. It should be noted that generally the drops for printing are non-deflected drops, i.e., their charge binary level is zero.

In both technologies, that of the deviated continuous jet and that of the binary continuous jet, the ink which is not used for marking the substrate is directed towards a trough or recuperator of unused ink and is recycled in an ink circuit so that it returns to the printing nozzles.

A method for breaking the jet into drops is very well described for example in a patent bearing the number U.S. Pat. No. 4,220,958, whose inventor is M. CROWLEY. According to the method described by CROWLEY, the jet of conducting ink passes through electrodes to which a relatively high potential is applied periodically. Under the action of these electrodes, the ink jet is charged. The charges are attracted by the electrodes so that a force transverse to the jet deforms the surface of the jet. The axial velocity of the jet and the transverse movement of the surface of the jet combine in such a way that, at a certain distance from the electrodes, the jet is broken into a succession of drops.

In the description of the art prior to his invention, CROWLEY mentions a patent from Richard G. SWEET bearing the number U.S. Pat. No. 3,596,275. According to this citation, an important point of an ink jet printer is the generation of drops. It is preferred that the drops be generated at a fixed frequency with constant mass and velocity. To achieve this goal, SWEET discloses three techniques which are illustrated in FIGS. 1, 2 and 10 of his patent.

According to a first technique, the ink-emitting nozzles are vibrated. According to a second technique, the liquid jet is electro-hydrodynamically excited with an electro-hydrodynamic exciter (EHD). A third technique is to impose a change in pressure on the liquid at the nozzle by means of a piezoelectric crystal introduced into a cavity for feeding the nozzle. This last technique predominates in the literature and is for example used in the IBM 6640 machine (registered trade mark).

In comparison with this state of the art, the invention of CROWLEY relates to an electro-hydrodynamic exciter in which the length of the electrodes crossed by the ink jet is equal to half the distance between the drops.

Another ink jet stimulation method for transforming it into drops is described, for example in U.S. Pat. No. 4,638,328 of DRAKE et al. This deals with activation by thermo-resistive components.

A second so-called drop-on-demand ink projection printing family is essentially applied in office printers. This is a matter of printing texts or graphic color patterns on paper or plastic media. Unlike continuous jet printing, the drop-on-demand technologies directly and exclusively generate the ink drops actually required for printing the desired patterns. Therefore, neither electrodes nor ink recovery trough are found between the outlet face of a nozzle and the printing medium. These printers include a plurality of nozzles, each nozzle is associated with a stimulation device having the dual function of expelling a drop (kinetic energy) and of controlling the formation (profile of the drop). This stimulation device which is activated on demand by an electrical signal offers two main alternatives:

"Bubble jet" technology initially developed by Canon and Hewlett-Packard is mainly applied in the field of office automation. A heated component placed in a conduit locally produces vaporization of the ink; the growth of the gas bubble produces the expulsion of a droplet of ink towards the printing medium.

The "piezoelectric" technology is based on the deformation of a piezoelectric ceramic so as to generate an overpressure and thereby to project ink drops. The fields of application of this technology concern office automation (Epson) or industrial printing (Trident, Xaar, Spectra).

The point density provided by these printers of the order of 600 points per inch results from the use of materials and manufacturing techniques developed for the micro-electronics industry.

In the field of industrial printing, the performances of continuous ink jet printing heads outclass the capacities of the drop-on-demand versions. The former provide:

- a more extended usable ink range and consequently a wider variety of printable media,
- a higher drop emission frequency and therefore an increased printing rate (about 100 kHz and a few meters per second versus about 10 kHz and a few centimeters per second),
- a printing distance from the lower face of the printing head to the upper medium (about 10–30 mm versus 1 mm).

However, the simplicity of the design of the drop-on-demand printing heads is again not found in the binary continuous jet multi-nozzle printers. The electrodes dedicated to charging the drops of each jet, may be controlled individually, by the frequency for forming the drops and at voltage levels which may attain 350 volts. Manufacturing and juxtaposition with a very fine step, of the whole of the nozzles and electrodes of a printing head then cause the occurrence of major problems:

- manufacturing and cost problems: multiplication of the high voltage electronic circuits connected to the charging electrodes and multiplication of these same charging electrodes induce a complex and costly electronic control,
- use and performance problems: the very dense high voltage connector technology near the jet causes undesirable crosstalk, the effect of which on the printing quality can only be limited by reducing the rate of use of the drops, and consequently by reducing the printing rate, and/or reducing the resolution.

In view of retaining the advantages of the binary continuous jet while finding a remedy to the drawbacks, one alternative consists of using a system for charging and deviating the drops, common to all the jets.

A first invention with Vago as inventor is described in Patent Application EP 949077 or U.S. Pat. No. 6,273,559 which provides a stimulation device operating at frequency F, and driven by two voltage levels. Depending on the voltage applied to this stimulation device, the breaking point of the jet is produced at a point C or at a point L. Before proceeding further on, the following should be known.

Let us consider a jet subject to periodic stimulation, the latter is broken into a train of drops with a special period called a wavelength. Inside a wavelength, several drops may be formed which accompany the main drop (the one with the largest volume). In the ink jet business, these secondary drops are called satellites. This notion differs without any ambiguity from the term of section which designates continuous portions of jets including at least two wavelengths. For this first invention of Vago, the difference in the voltage level applied to the stimulation means is such that the breaking points of the jet C and D are separated from one another by a distance which is strictly less than the wavelength of the jet. The breaking point C is at a position where there exists a potential equal to that of the ink, so that the drops formed at C are not charged. These uncharged drops are not subsequently deviated by deviation electrodes and will print the printing substrate. The breaking point L is at a position where there exists a potential different from the one of the ink, so that the drops formed at L are charged. Theses charged drops are subsequently deviated by the deviation electrodes and are directed towards a recovery trough in order to be recycled in the ink circuit. Point C is substantially found at half distance between the upstream and downstream sets of electrodes brought to equal potentials but of opposite sign. The C-L distance is too short for creating sections.

Patent Application No. FR 2 799 688 with US filing number Ser. No. 09/685,064 as of 10.10.00, object of a second invention of Vago, the publication in the journal Xerox Disclosure (Pincus—1982, Vol. 7, p. 23) describe a charging and sorting system based on a set of electrodes brought to constant potentials. Fragmentation of the jet is located in the set of electrodes and preferentially facing a well identified electrode according to whether the jet portion should be printed or collected by the trough. During operation, the jet appears as a succession of electrically insulated drops, i.e., without any drop-borne electrical charge, physically distinct, flanked by electrically charged sections which are deflected towards the trough. Generation of isolated drops (with zero electrical charge) is triggered by an intermittent stimulation system not described. In a known way per se, the intermittent stimulation of a jet may be provided by an electrohydrodynamic (U.S. Pat. No. 4,220,958—Crowley) or thermal actuator (U.S. Pat. No. 3,878,519—Eaton). In both cases, these are so-called external stimulation techniques as they consist of acting on an already formed jet. With an external stimulation technique, it is possible to easily form an isolated drop in a jet to the extent that the liquid flows past the stimulation device, for which the radius of action has a small range, and two configurations appear.

In the absence of a stimulation signal, the jet is not perturbed and remains continuous up to the natural breaking position.

Application of a stimulation signal selects a perfectly defined jet portion, the length of which only depends on the forward movement velocity of the jet and on the duration of the excitation signal. Under the effect of the surface tension, the stimulated jet section with a properly selected length will produce an isolated drop in the continuous jet.

In the second invention of Vago, the breaking position of the continuous jet, in order to form a drop on demand, is placed in an area where an electrode common to all the nozzles of the printing head maintains a potential equal to that of the ink in the printing head. A charging electrode is placed downstream from this breaking position. As long as the jet is not broken, because the ink used is conducting, a jet portion placed downstream from the breaking position is found in the influence area of the charging electrodes. On the other hand, when the drops are formed before passing through the electric field of the charging electrodes, they are electrically isolated and are not charged.

These uncharged drops formed on demand are not deviated by the deviation electrodes placed downstream from the charging electrodes. They will therefore print the printing substrate. The sections which are themselves charged, are deviated by the deviation electrodes towards a recovery trough. In the second invention of Vago, the command for writing a drop is not performed as in the continuous jet printers, at charging electrodes, placed in the ink flux downstream from the nozzles for ejecting ink but at the stimulation means which are located downstream from these nozzles. Such a device in which formation of drops in the jet is perturbed upstream from the nozzle is said to be with internal stimulation. The first and second inventions of Vago thereby associate the advantages of the drop-on-demand printing with those of the continuous jet.

DISCUSSION OF THE INVENTION

The present invention as the first and second inventions of Vago, aims at associating the advantages of drop-on-demand printing with those of the continuous jet. As a reminder, these advantages notably include:

Suppression for each jet, of the set of individual electrodes for charging the drops and of the control circuit associated with this set of individual electrodes.

Application of digital data defining the pattern to be printed, no longer downstream from the nozzles, but upstream, at the means for stimulating the jet. These are the data which will either determine or not the formation of the drops used for printing.

Quality of printing is thereby enhanced by suppression of the crosstalk by means of electrostatic coupling between the different jets of a same printing head. Further, manufacturing is simplified and the global size of the printing heads is reduced.

The invention also aims at these advantages but with enhancements which will be described hereafter.

In the device described in the second invention of Vago, the charging electrodes must create a charging field in a separate area from the protection area reserved for drops intended for printing, with at the most the diameter of a drop. In this way, the shortest sections, the length of which is about two drop diameters, before the break, have a portion located in the charging area and may be charged. Further, it is preferable that the charging electrodes have an area of influence, the length of which in the direction of the axis of the jet, is sufficiently large to ensure charging of a section proportionally to the length of said section, and therefore to its mass. In this way, sections of different lengths and therefore of different masses are all deviated in an identical way and an inlet port of the recovery trough may retain a reasonably small size, while ensuring recovery of all the sections regardless of their length.

The present invention also aims at better controlling the ink jet portions not intended for printing. It also aims at simplifying the manufacture of printing heads by loosening tolerances on the position of the electrodes common to all the nozzles of the head. It also aims at increased compaction of the global dimensions of the printing head, and a larger printing distance.

According to the invention, instead of breaking up the jet, exclusively for creating the drops required for printing, the jet being then divided into drops and jet portions, it is also broken up in a regular and controlled way to create drops which will for example be electrically charged and deviated by deflection electrodes. For this, means for stimulating the jet, intended to break the jet, are capable of causing break-up of the jet in the two positions of the jet axially separated from each other, an upstream breaking position and a downstream breaking position, the latter being more downstream in the forward direction of movement of the jet than the upstream position. At the upstream breaking position, the jet will be intermittently broken up in order to create ink drops which will be used for printing. Thus, after the upstream breaking position, the jet may be continuous from the nozzle, if no intermittent drop has been formed, or on the contrary, distributed as drop(s) and section(s) if one or more intermittent drops have been formed. The upstream breaking position will for example be an area in which electrodes maintain a potential equal to the one of the ink in the printing head, so that the intermittent drops will not be charged electrically. The downstream breaking position is commented here in the example, in an area where charging electrodes maintain a potential different from the one of the ink in the printing head so that the continuous drops will be charged electrically. At the downstream breaking position, it is the jet which is broken up if there has not been any intermittent break-up at the upstream position, on the other hand, if there has been a break at the upstream position, the jet section resulting from this is continuously divided into drops. Thus, after the downstream breaking position, the jet is entirely divided into drops. Deflection electrodes located downstream from both breaking positions then allow sorting to be performed between the charged drops and the uncharged drops for sending the ones to a recovery trough and the others to a printing medium.

Thus, the invention is relative to an ink jet printer comprising:

- a printing head with one or more nozzles with an accommodating head body notably for each nozzle,
- a hydraulic path of the ink including a stimulation chamber in hydraulic communication with one of the printing nozzles emitting a pressurized ink jet along an axis of this nozzle,
- internal means for stimulating the ink jet emitted by the nozzle, mechanically coupled with the ink accommodated in the stimulation chamber, these means acting on the jet emitted by the nozzle for breaking up the jet in a controlled way, and
- means for recovering the ink which is not received by a printing substrate,
- a generator of electrical control signals, receiving a control signal and delivering stimulation signals to the stimulation means,
- an arrangement of charging electrodes defining around the axis of the nozzle, upstream and downstream areas, the downstream area being further away from the nozzle than the upstream area, upstream and downstream electrodes of this arrangement being connected to sources of electric potential in order to maintain in one of the areas a potential equal to the one of the ink found in the body of the printing head, and in the other one of these areas, a potential different from the one of the ink found in the body of the printing head,
- an arrangement of deflection electrodes axially located downstream from the arrangement of charging electrodes characterized in that the generator of electrical control signals delivers to the stimulation means, signals intermittently causing the controlled break-up of the jet in a upstream breaking position located in the upstream area in order to intermittently form a drop, thereby separating the jet into a drop and a section and also causing controlled break-up of the jet or of sections of the jet continuously in a downstream breaking position, the continuous jet emitted by the nozzle being thereby transformed after the downstream area in a continuous train of electrically charged and uncharged ink drops.

The generator of electrical control signals may be physically separated from the printing head. It may also be part of it, physically. In the latter case, the invention also relates to the printing head.

In an embodiment, the printer or the printer head according to the invention is characterized in that the upstream electrode or the arrangement of charging electrodes is connected to the same potential as the ink.

Thus, in this embodiment, the charged drops are the ones which result from the break-up of the jet or of jet sections in the downstream area. They are deviated by the arrangement of deflection electrodes towards means for recovering the ink. Each period of the periodic signal creates a mechanical reaction of the stimulation means, this reaction causing the breaking of the jet or of jet sections in the downstream area. Each intermittent pulse of the pulse signal creates a mechanical reaction of the stimulation means causing the breaking of the jet in the upstream area into a drop and a section. In a way known per se, the charged drops may be directed towards the printing substrate and the uncharged drops towards the means for recovering the ink. In this case, it is sufficient that the upstream breaking position, where the drops intended for printing are formed, be in an area where an arrangement of electrodes maintains a potential different from the one of the ink, whereas the potential maintained in the downstream area has a value equal to that of the ink.

In an embodiment, the printer or the printer head according to the invention is characterized in that the stimulation means include a piezoelectric material, the generator of electrical control signals delivering to the stimulation means, a continuous printing signal formed by a periodic signal with period Tb, intermittently replaced by a pulse signal preceded and followed by transition signals.

In an embodiment, the printer or the printer head according to the invention is characterized in that the pulse signal delivered by the generator of electrical control signals is formed by a pulse including 3 consecutive voltage steps each connected to the next by a rising front or a steep voltage fall.

In an embodiment, the printer or the printer head according to the invention is characterized in that the pulse signal delivered by the generator of electrical control signals, is formed by a succession of 3 rectangular pulses separated from each other by voltage steps with a lower level than the level of the pulse with the lowest level.

In an embodiment, the printer or the printer head according to the invention is characterized in that the periodic signal delivered by the generator of electrical control signals is formed by a signal, the spectrum of which consists of two lines at a first frequency and a line at a second frequency double of the first, of other possible lines of the spectrum having coefficients much smaller than the coefficients associated with the lines of the first or second frequency, for example a signal resulting from a combination of two sinusoidal signals. The periodic signal delivered by the generator of electrical control signals may also be formed by a combination of more than two sinusoidal signals.

In an embodiment, the printer or the printer head according to the invention is characterized in that the sum of the durations of the pulse signal and of the transition signals delivered by the generator of electrical control signals is equal to an integral number of periods of the periodic signal.

In an embodiment, the printer or the printer head according to the invention is characterized in that a Helmholtz frequency of a portion of a hydraulic path of the ink feeding a nozzle located downstream from a restrictor, has a value located outside a bandwidth of the jet issued from this nozzle.

In an embodiment, the printer or the printer head according to the invention is characterized in that the hydraulic path of the ink includes a restrictor and in that the length of a hydraulic path between an inlet of the restrictor and the nozzle is less than the quarter of the wavelength of sound in the ink.

In an embodiment aiming at avoiding generation of undesired breaks, i.e., avoiding the formation of droplets between the drops which one actually wants to form, and the other portions of the jet or jet sections, the printer or the printer head according to the invention is characterized in that the system for stimulating a jet emitted by a nozzle is strictly non-resonant, i.e., the transfer function of the stimulation system is free of any resonance peaks in the bandwidth of the jet. As a reminder, the transfer function of the stimulation system is defined as the relationship existing between the pressure induced by the action of the piezoelectric component and the velocity modulation introduced in the ejection velocity of the jet. The stimulation system therefore comprises not only stimulation means but also the hydraulic path of the ink in the body of the printing head.

Explanations will be given later on, on how to obtain such a result.

In an embodiment, the printer or the printer head according to the invention is characterized in that the stimulation means include in addition to the piezoelectric material, a membrane which is mechanically coupled with it, a resonance frequency of a vibrating component formed by the membrane and the piezoelectric material, being higher than a cut-off frequency of the jet.

Finally the invention also relates to a method for printing a medium by means of a printer according to the invention in one of its embodiments wherein an ink jet emitted by a nozzle of the printer is fractionated in order to intermittently form first drops which impinge on the substrate in order to form points, and sections, characterized in that, the jet or the sections resulting from the fractionation of the jet into first drops and sections, are fractionated into second drops, the second drops resulting from this last fractionation being directed towards the trough.

SHORT DESCRIPTION OF THE DRAWINGS

Complementary explanations and an exemplary embodiment of a printer or a printer head according to the invention, will now be given in connection with the appended drawings wherein, FIG. 1 is a perspective diagram for explaining the operating mode of an ink jet printer according to the invention;

FIG. 2 includes the portions a and b. Portion a is a diagram showing the method for breaking up the jet in the situation of non-printing, portion b is a diagram showing the method for breaking up the jet in a printing situation;

FIG. 3 includes portions a to g. Each of the portions shows a step of the usual method for breaking the jet;

FIG. 4 includes portions a and b. Portions a and b are graphs bearing in ordinates, voltage values and in abscissae, duration values, each showing an example of a pulse signal, which may be applied to the stimulation means in order to obtain an intermittent break-up of the jet;

FIG. 5 includes portions a to d. Portions a to d are graphs bearing in ordinates, voltage values and in abscissae, duration values, the graph in portion a is an example of a signal which may be applied to the stimulation means in order to obtain a faultless break-up of the jet in the non-printing situation; the graph in portion c is an example of a signal which may be applied to the stimulation means in order to obtain a faultless break-up of the jet in the printing situation; the graphs of portions b and d each illustrate a logical state of a printing control signal;

DETAILED DISCUSSION OF PARTICULAR EMBODIMENTS

Figure 1:
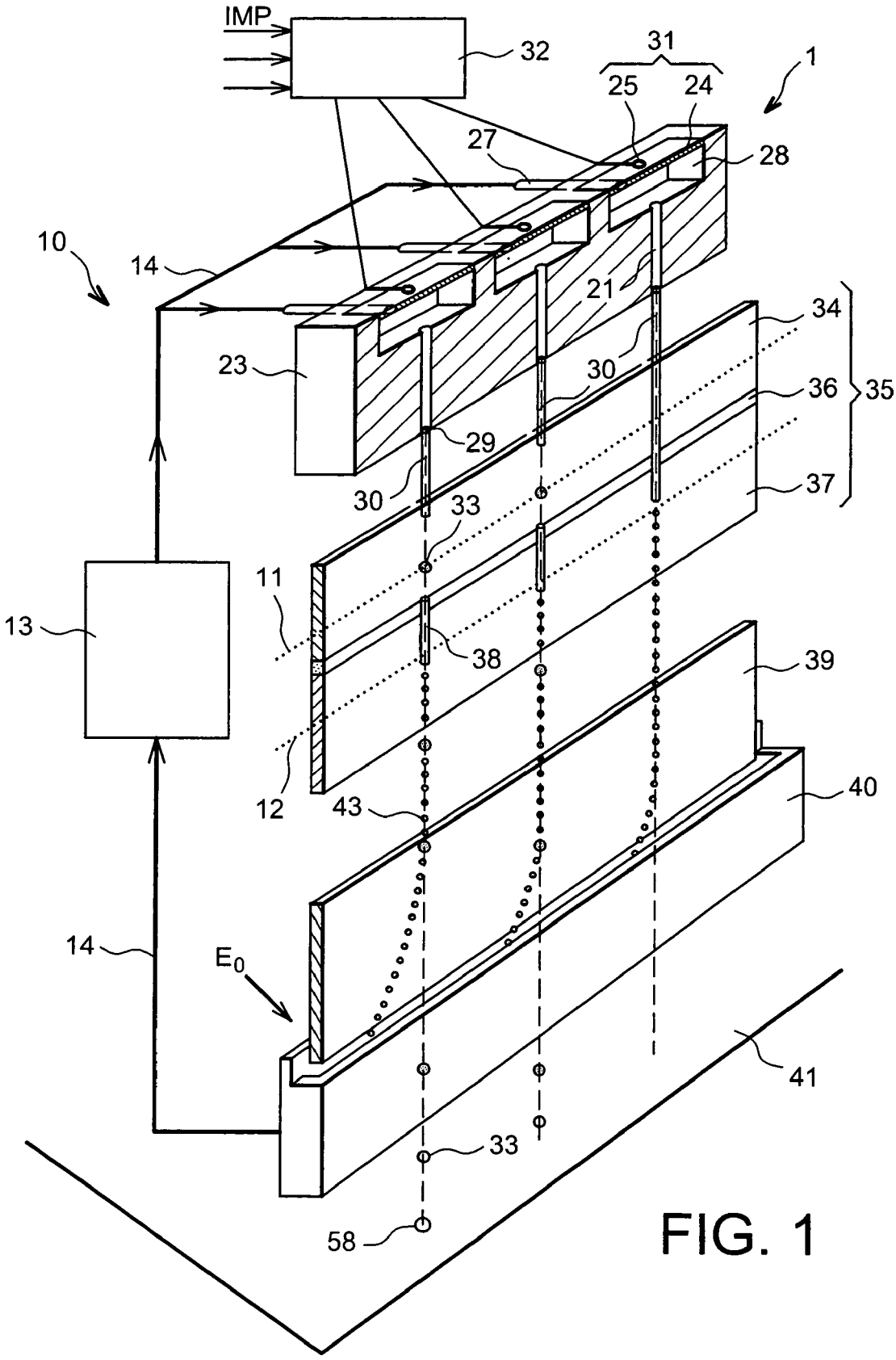

FIG. 1 schematically illustrates in perspective the portions of a printer concerned by the invention. In this figure, the means for transporting the printing medium are notably not illustrated. This figure is essentially intended for explaining the operation of a printer based on the present invention.

In the shown exemplary embodiment, the printer 10 includes one, as illustrated, or several printing heads 1. A printer head 1 including 3 nozzles 29 for injecting an ink jet 30 is illustrated in FIG. 1. Actually, the number of nozzles is much larger. For each of the nozzles, a body 23 of the printing head notably includes a hydraulic path for the ink and a stimulation chamber 28 which will be described in more detail later on in connection with FIG. 6. Each stimulation chamber 28 in a way known per se is constantly filled with ink maintained at constant pressure by a pressurized ink supply 27. Each stimulation chamber 28 includes stimulation means 31 each formed by a piezoelectric component 25 and a membrane 24. A signal generator 32 for controlling stimulation means 31 is connected to each of the piezoelectric components 25. IMP control signals intended for each of the stimulation means 31 are received by the circuit 32 preferably, as illustrated in FIG. 1, on a parallel bus including a route for each means 31. An ink supply circuit common to the chambers 28 is symbolized in this figure by arrows 14 showing that ink drops 43 formed in a downstream breaking position of the jet 30 or of sections 38 of the jet are recovered in a trough 40 common to the set of nozzles of a head and directed towards pressurization and suction means symbolized by a block 13. Such an ink circuit feeding pressurized ink 16 to each of the inlets 27 of the chamber 28 is known per se.

Pressure exerted on the ink is sufficiently large to cause the ejection of an ink jet 30, through each ink ejection nozzle 29, at an average velocity Vj. A nozzle 29 has a section, the equivalent radius of which is equal to "a", which is also approximately the radius of the jet 30. With the stimulation device 31, controlled by the generator of electrical signals 32, it is possible to create a perturbation inside the chamber 28, causing the break-up of the jet 30 into drops 33, 43. According to the invention, the electrical stimulation signals are such that they intermittently cause break-up of the so-called intermittent jet in a first axial position 11 on the one hand and a second break-up of the jet in a second axial position 12 downstream from the first one, so-called continuous break-up, on the other hand. The drops 33 are the drops resulting from the intermittent break-up and the drops 43 are the drops resulting from the continuous break-up. Examples of signals, capable of causing the intermittent and continuous break-ups, will be given later on. A charging electrode 35 common to all the nozzles 29 is located downstream from the nozzles 29, in direct vicinity of the axes of the nozzles 29. In the example commented here, the charging electrode 35 is formed by a stack of two electrically conducting materials 34, 37, separated by a layer 36 consisting of an electrically insulating material. The conductor 34 is the most upstream, the conductor 36 is the most downstream from the charging electrode 35. The conductor 34 is connected to the same potential as the ink found in a chamber 28, generally the zero potential of the electrical ground. The conductor 36 is connected to a non-zero electrical potential Vc, different from the one of the ink found in a chamber 28. A set 39 of deflection electrodes is found in direct vicinity of the axes of the nozzles downstream from the charging electrode. The set 39 of deflection electrodes is common to all the nozzles 29 of a head and is connected to a potential source so that a uniform electric field E0 prevails, whose component perpendicular to a plane containing the axes of the nozzles 29 predominates. A recovery trough 40 common to the set of nozzles and located downstream from the set 39 of deflection electrodes and outside the axes of the nozzles 29 is used in known way for recovering the ink which is not used for printing. The used ink for printing is directed towards a printing medium 41 on which each printing drop 33 forms a printing point 58.

Operation of the printing head is the following.

In the example commented here, the drops 33 are the drops which are used for printing. The drops 33 result from intermittent breaking up of the jet creating an isolated drop, called an intermittent drop 33. The electric charge of the intermittent drops 33 is quasi-zero as they are formed in the first breaking position of the jet, facing the conductor 34 brought to the same potential as the ink found in the chamber 28, generally the zero potential of the electrical ground. After intermittent break-up, the jet 30 is split into the drop 33 and a jet section 38.

The drops 43 are those which are not used for printing. They are formed at the second breaking position, facing the conductor 37 of the charging electrode 35 brought to the non-zero electrical potential Vc, different from the one of the ink found in chamber 28. The drops 43 are loaded by electrostatic influence with a larger electric charge in absolute value than the quasi-zero charge loaded by the drops 33. The second breaking position 12 where the drops 43 are formed, is downstream from the first breaking position 11 where the intermittent drops 33 are formed. This break-up is called a continuous downstream break-up of the jet sections 38, or of the jet 30 if the intermittent break-up has not formed any sections. All the drops which separate from the jet then pass into the deflection area defined by the deflection electrode 39. The ink drops 33, 43 passing through the deflection area are subject to an electrostatic force $F=q.E0$, q being the electrical charge of the relevant drop. The intermittent drops 33, the electrical charge of which is quasi-zero, therefore follow a quasi-rectilinear trajectory along the axis of the nozzle 29, up to the printing medium 41. The trajectories of the drops 43 are themselves deflected perpendicularly to the axis of the jet according to their electrical charge and end their trajectory in the recovery trough 40, assuming that a suitable combination of electrical potentials is applied to the charging and deflection electrodes 35, 39. The ink collected in the trough 40 is, in a known way, re-injected into the ink circuit in order to be reused.

The printing of a pattern in a known way per se results from the selection of ink drops to be directed towards the printing medium 41 or towards the trough 40 and from a relative movement of the printing medium 41 and the printing head 1. In the example commented above, the uncharged drops, the trajectory of which is not deflected, are the ones which are used for printing. Generally, this solution is preferred as the accuracy of the positioning of the drops contributing to the printing is higher, because the trajectory of these drops is shorter and less dependent on uncertainties relative to the exact mass of the drop, to the value of the drop-borne amount of electric charge and possible fluctuations of the deflection field. According to the invention, the use, as in certain known embodiments, of deviated drops for printing is not excluded while the undeviated drops are directed towards the trough.

One of the main advantages of the invention is that, as in the second invention of Vago, the set of charging 35 and deflection 39 electrodes, forming together a system for sorting drops 33 for printing and drops 43 to be recovered, is common to all the jets. However, because the sections 38 formed whenever an intermittent drop 33 is formed, are, in a downstream position, also fractionated into drops 43, the trough 40 common to all the jets may be of a more reduced size as the drop guiding accuracy is enhanced.

Figure 2:
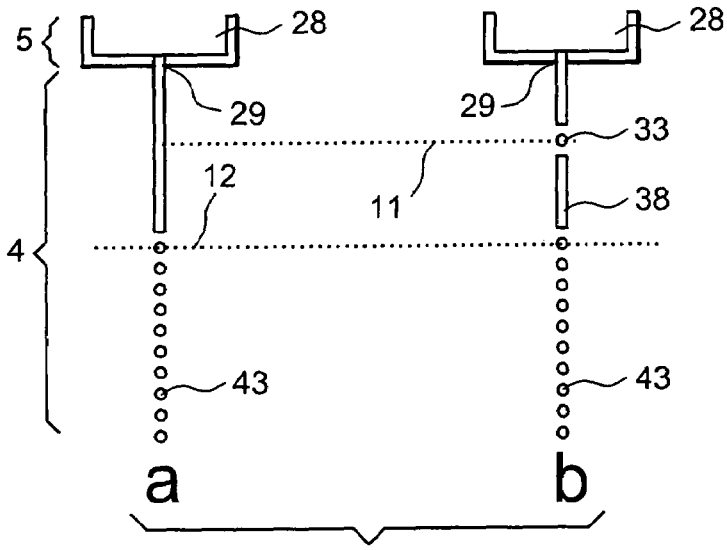

FIG. 2 is intended to illustrate the breaking modes of the jet in order to form the intermittent 33 and continuous 43 drops. In FIG. 2 portion a, a phase is found in which there is no printing, or in which there has not been any intermittent break-up during the time taken by the jet for moving from the upstream breaking position 11 to the downstream breaking position 12. In this case alone, a periodic signal continuously breaks the jet at the downstream position 12 in order to form continuous drops 43. In FIG. 2, portion b, the case is illustrated when a drop 33 is for example formed by a pulse of the breaking signal. In this case, the jet 30 is split into a drop 33 and a section 38 of the jet. This section bears the velocity perturbation provided by the periodic signal. It is therefore broken up at the downstream breaking position 12 in order to provide continuous drops 43. Thus, downstream from the downstream breaking position, the jet is entirely divided into drops 33 and 43.

Forms of electrical signals able to cause the intermittent breaking at the upstream breaking position 11 on the one hand, the downstream continuous breaking at the downstream breaking position 12 on the other hand, and finally a composition of the breaking signals in the upstream and downstream positions, will now be discussed.

First it should be noted that the intermittent break-up is a break-up intended to isolate a drop from a jet. This situation is different from the situation where a continuous train of drops is generated, because, in the case of the isolated drop, satellite droplets and beads tend to form, which are detrimental to the printing quality. To understand the benefit of possible forms of the intermittent breaking signal, the breaking dynamics of an isolated drop will be described hereafter in connection with FIG. 3, which for the invention corresponds to the case of the intermittent drop.

Figure 3:
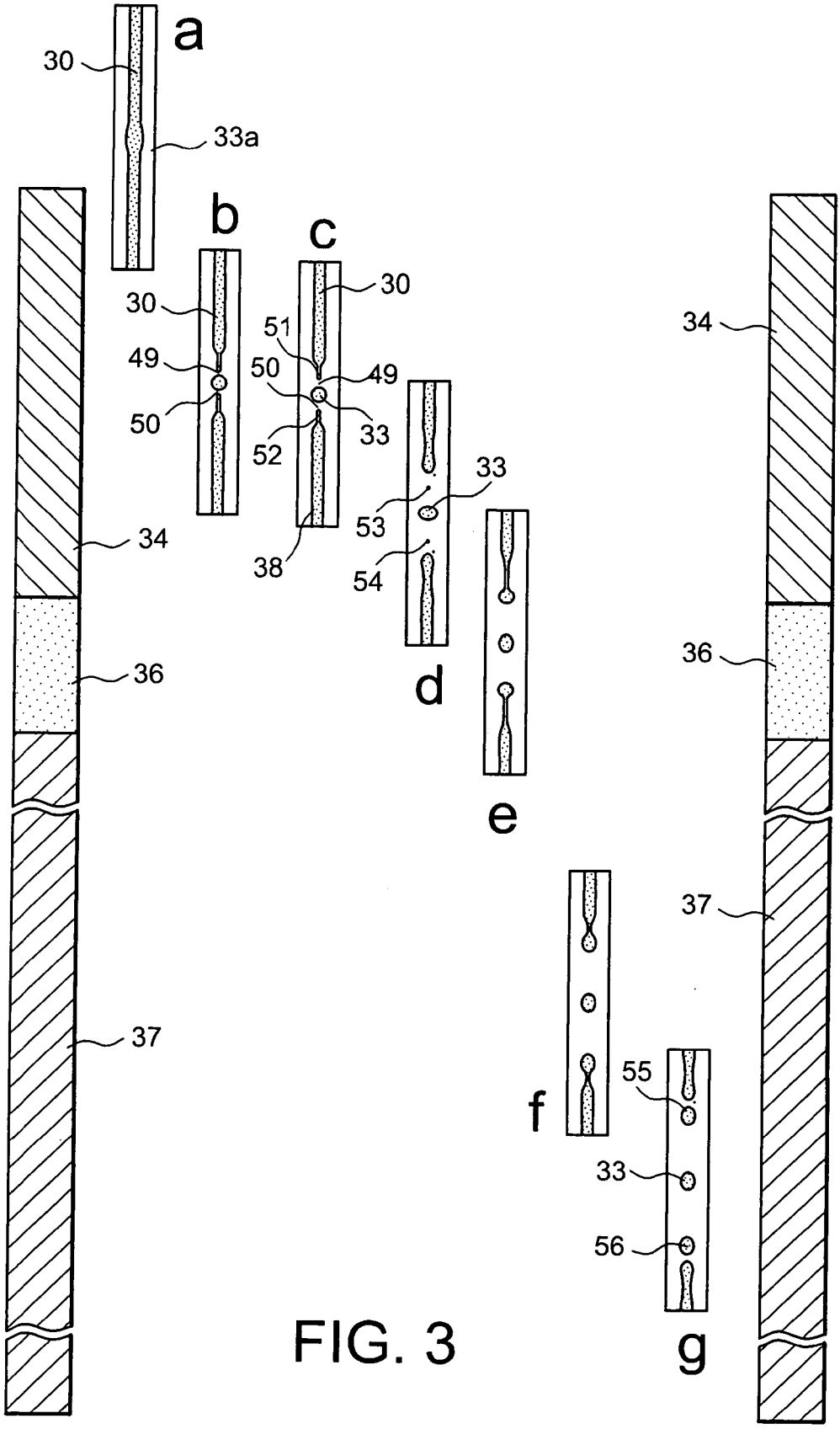

FIG. 3 includes portions a to g. The sequence of portions a to g show a time succession of states of the intermittent break-up for presenting the dynamics of break-up. In a first stage illustrated in a, a velocity perturbation provided by an induced temporary overpressure, at the chamber 28, generates a ventral segment 33*a* in the jet.

An intermittent drop 33 consecutively separates at two breaks: an upstream break 49 illustrated in portion b by a space between the upstream portion of the jet 30 and the downstream portion, and a downstream break 50 illustrated in portion c by a space between the drop 33 which is formed at this stage and the downstream portion of the jet 30 which therefore becomes a jet section 38. Upstream 51 and downstream 52 ligaments illustrated in portions b and c which respectively correspond to stretches of upstream and downstream portions of the jet 30 relatively to the forming drop 33, may, if stretching is significant, respectively give rise to upstream 53 and downstream 54 satellite droplets illustrated in portion d. In portion d, it is also seen that the upstream and downstream portions of the jet on either side of the forming drop 33 are subject to swelling. As illustrated by the succession of states illustrated in portions e and f, these swellings of the ends of the jet and of the jet section surrounding the forming drop 33, may also separate in order to form ink drops 55, 56 illustrated in portions g. These upstream and downstream ink drops 55, 56 will subsequently be called upstream bead 55 and downstream bead 56. An upstream breaking length Lbam is defined as being the Lbam distance between the output face of the nozzle 29 and the upstream break 49, a downstream breaking length Lbav is defined as being the Lbav distance between the output face of the nozzle 29 and the downstream break 50.

In order that the beads 55, 56 be recovered in the trough 40, it is necessary that the latter bear a sufficient electrical charge, and therefore that they separate sufficiently far downstream from the upstream and downstream breaks 49, 50 of the intermittent drop 33 so that, at the moment of their separation from the jet, they are found in the area where a potential different from the potential of the ink in the chamber 29 exists. This is why in FIG. 3, portions f and g, the beginning and the end of the separation of the beads 55, 56 are illustrated in the area subject to the influence of the electrode 37. Also, it is desirable that the upstream and downstream satellites 53, 54 be rapidly absorbed in other drops, as they may significantly dirty the sorting system or even the printing medium.

Any electrical signal applied to the stimulation device 31 and with which break-up features may be obtained so that the satellites and beads do not introduce any printing defects as explained above, may be used for achieving the invention.

Figure 4:
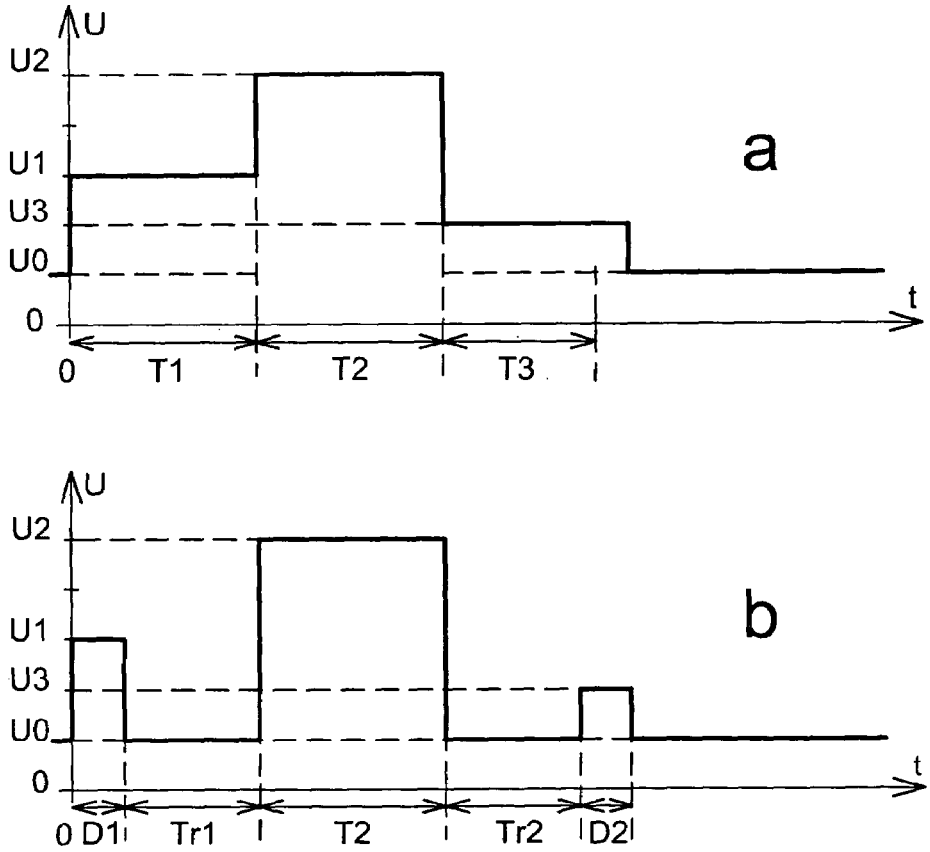

FIG. 4 portion a, shows an example of an electrical control signal which may be applied to the stimulation device 31 in order to control the shape of the intermittent breaks so as to ensure proper operation of the sorting of the drops to be printed 33 and of the drops 43 to be recovered in the trough 40.

The signal illustrated in FIG. 4 portion a, consists of three consecutive voltage steps with the respective levels $U_1$, $U_2$, and $U_3$, measured above a level $U_0$. The three steps have respective durations $T_1$, $T_2$, and $T_3$. Two consecutive steps are connected to each other by a steep rising or falling edge.

The durations $T_1$, $T_2$, and $T_3$ of three consecutive voltage steps which form the stimulation signal are each close to a duration $\tau opt$. $\tau opt$ is the duration of a rectangular pulse which would give, if it was applied to the stimulation means 31, the shortest upstream intermittent breaking length, with a constant amplitude and for the same jet (same velocity, same section, same ink). $\tau opt$ is a duration which corresponds to a spatial perturbation of the jet with a length of $\lambda opt/2$, where $\lambda opt$ is the optimum wavelength of the jet, i.e., the wavelength for which the coefficient for amplifying the capillary instability is maximum.

As $\lambda opt \cong 10.a$ for a viscous liquid, one obtains $\tau opt = \lambda opt/2.Vj \cong 5.a/Vj$.

As a reminder, in the above formulae, a is the equivalent diameter of the nozzle 29 which substantially corresponds to the diameter of the jet 30 and Vj is the ejection velocity of the jet 30.

In the commented example in connection with FIG. 4*a*, the characteristic durations $T_1$, $T_2$, and $T_3$ were selected to be equal to each other, i.e., $T_1$, $T_2$, and $T_3 = \tau opt$, so the shape of the obtained break for forming an intermittent drop 33 is stable, and therefore not very sensitive to slight variations of the jet velocity, of the viscosity or other fluctuating properties of the jet.

In addition, the principle of sorting the drops requires that the electrical charge borne on the intermittent drop 33 is quasi-zero in this example. Now, the electric charge actually borne on this drop depends on the geometrical configuration of the charging electrode 35, on the electrical potentials applied to the 2 conductors 34, 37 which form it, but also on the algebraic distance between the upstream and downstream intermittent breaks (Lbav-Lbam).

With the signal illustrated in FIG. 4 portion a, this distance (Lbav-Lbam) between the two breaks forming an intermittent drop may be controlled so as to ensure a stable and well defined trajectory of the drop to be printed.

The distance (Lbav-Lbam) between the upstream and downstream breaks forming a drop may be adjusted by changing certain parameters of the stimulation signal. In this embodiment, adjustment of the amplitude $U_1$, $U_2$, and $U_3$ of the steps forming the pulse signal allows adjustment of (Lbav-Lbam). More specifically, a reduction of the absolute value of the absolute difference |U1−U2| between the voltage values of the first two steps results in delaying the moment of the downstream break, and so a reduction of the absolute difference |U2−U3| between the voltage values of the last two steps results in delaying the moment of the upstream break. It is possible to select T1=0 or T3=0, if one of the three steps of the signal is estimated to be unnecessary by the skilled practitioner, depending on the particular operation of the relevant stimulation device. With the signal shown, it is possible to correct the trajectory of the drop to be printed by empirically selecting the parameters of the signals which have an influence on the distance (Lbav-Lbam) between the upstream intermittent break and the downstream intermittent break.

Another example of a pulse stimulation signal which may be used in one embodiment of the invention is described in FIG. 4 portion b. This signal consists of a succession of three rectangular pulses, a first pulse with duration $D_1$ and level $U_1$, a second one with duration $T_2$ and level $U_2$, and a third one with duration $D_2$ and level $U_3$. The first and second pulses are separated from each other by duration $Tr_1$, and the second and third pulses are separated from each other by duration $Tr_2$. During the separation times between pulses, the signal is at the base level $U_0$. If this signal is selected for controlling the intermittent break, the durations preferably are $T_2 \cong \tau opt$; $Tr_1 \cong Tr_2 \cong \tau opt/2$; $D_1$ and $D_2$ are close to $\tau opt/10$ or $\tau opt/5$ according to the stimulation device to be controlled, $\tau opt$ being defined as earlier. The distance between the upstream and downstream breaks of the intermittent drop 33 may then be adjusted by changing $U_1$ and/or $U_3$: the instant of the downstream break is delayed when $U_1/U_2$ increases, the instant of the upstream break is delayed when $U_3/U_2$ increases.

We will now proceed with describing a signal able to generate the breaking of the jet or jet sections in the second so-called downstream position, producing drops 43 which will be recovered by the trough 40.

Application of a simple sinusoidal signal would cause generation of satellite droplets between the main drops 43 issued from this break. In the embodiment described here, continuous break-up without any satellite with a sufficiently weak amplitude signal in order to place the downstream continuous break-up in the vicinity of the charging conductor 37 is obtained by applying a signal with two modes, superimposition of two sinusoidal signals with frequencies Fb and 2.Fb, with properly selected relative amplitudes and phase lags. The generated signal has the form:

$$Sb(t)=Ab.(\sin(2\pi.Fb.t)+\alpha.\sin(4\pi.Fb.t+\phi) \quad (1)$$

In formula (1) above, Fb=1/Tb is the fundamental frequency of the continuous stimulation signal for forming drops 43. $\alpha>0$ is the relative amplitude of the second mode, and $\phi$ is its relative phase. Ab is a coefficient which determines the amplitude of the continuous stimulation signal for forming drops 43. The skilled practitioner knows how to select the values of parameters $\alpha$ and $\phi$ in order to obtain a continuous break-up without any satellite droplets. A signal such as described above, is illustrated in FIG. 5 portion a. This is a periodic signal with period Tb, the amplitude of which versus time is illustrated by formula (1). If this signal is applied alone continuously, breaking of the jet is obtained as illustrated in FIG. 2 portion a, where only drops 43 are produced.

The combination of the signals for generating drops 33 and 43 will now be explained. The time combination of both time signals, their combination from the point of view of relative amplitudes and finally a control mode for introducing a pulse signal into a succession of periodic signals will be successively examined.

Figure 5:
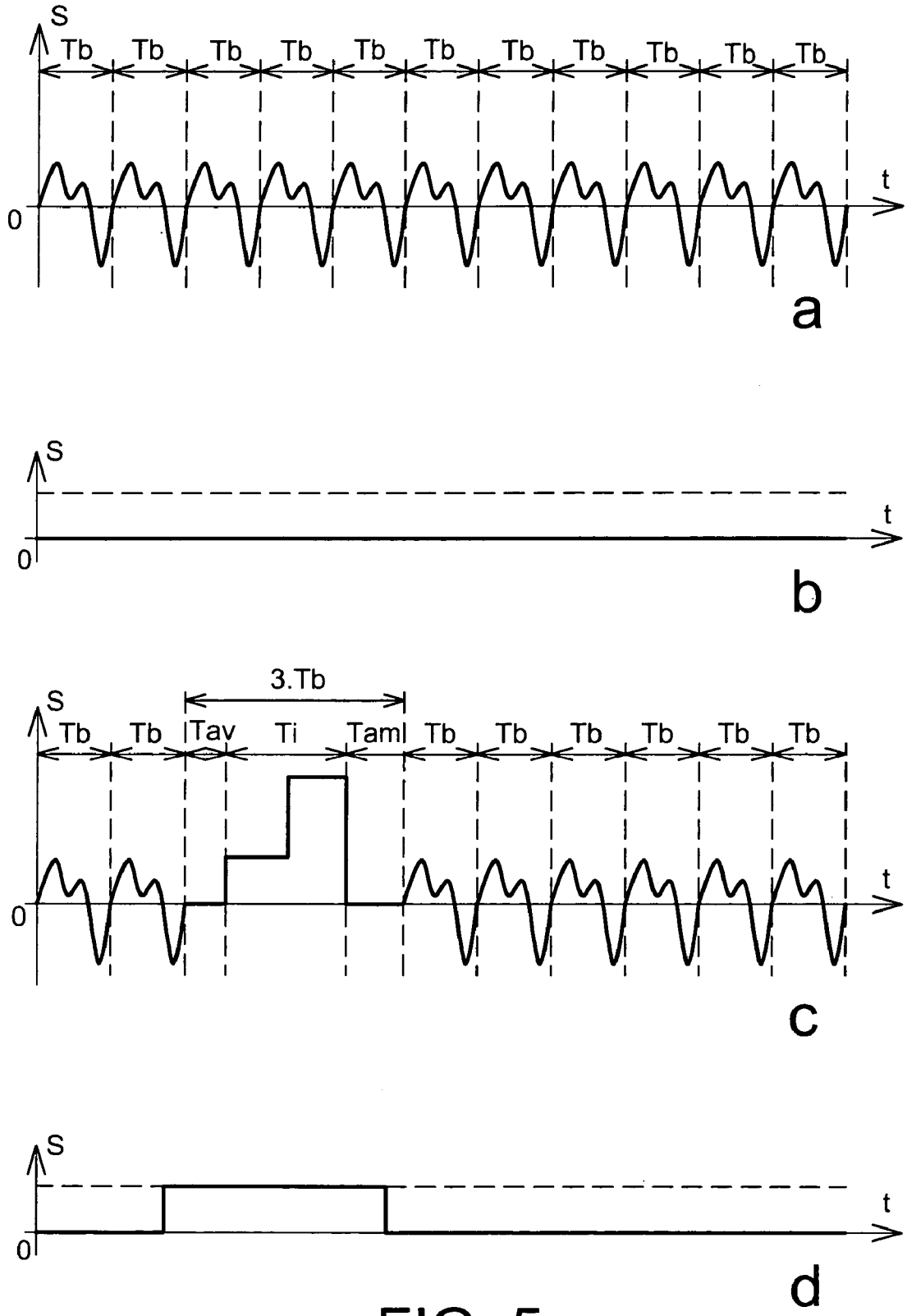

From the time point of view, at least one period Tb of the downstream continuous stimulation periodic signal is for obtaining an intermittent drop replaced, for example, by the pulse control signal described in connection with FIG. 4 portion a. The combination of the pulse signal described in connection with FIG. 4 portion a, and of the periodic signal described in connection with FIG. 5 portion a, is illustrated in FIG. 5 portion c. As shown by the example of FIG. 5 portion c, the total duration of the intermittent stimulation signal is equal to a value Ti. It is formed as illustrated in FIG. 4 portion a, by a succession of three consecutive steps with respective durations $T_1$, $T_2$, and $T_3$, $T_3$ having in this example zero duration, so that $Ti=T_1+T_2+T_3$. As a rule, $Ti \neq n.Tb$, n being an integer. In the selected embodiment, the pulse stimulation signal is preceded by a downstream transition signal with duration tav, and followed by an upstream transition signal with duration tam. Durations tav and tam are selected so as to satisfy the condition tav+Ti+tam=n.Tb. In the example described in connection with FIG. 5 portion c, the transition signals simply consist of holding the voltage constant between the interruption of the continuous stimulation periodic signal and the beginning of the generation of the pulse signal. Durations tav and tam are selected so as to observe the integrity of the jet sections 38 on either side of the intermittent drop 33 up to the area of influence of the charging conductor 37 (FIG. 1). The transition signals are also selected so as to ensure continuity of the applied electrical signal to the stimulation means 31 during interrupting and resuming generation of the downstream continuous stimulation periodic signal. It is noted that the transition signals may either one of them or both, have zero duration.

The relative amplitudes of the periodic signal and of the pulse signal, i.e., the relative values of Ab in formula (1) defining the periodic signal and the value of U2 are selected in order to properly place the upstream and downstream break positions in the areas of influence of the charging electrode 35. The breaking lengths, i.e. the distance between the nozzle 29 and a breaking position, depend on the amplitude of the stimulation. To ensure effective separation of the drops 33 relatively to the drops 43, the distance between the intermittent breaking position 11 and the downstream continuous breaking position 12 should be sufficient, at least 20 times the radius of the jet. In the preferred embodiment, a distance between these two breaking positions is close to 50 times the radius of the jet.

The electrical control signal generator 32 able to generate on demand the pulse signal for generating an intermittent drop 33 and the periodic signal for continuous generation of drops 33 and connected for this purpose to the stimulation means 31, is, in the described embodiment, driven by means of a printing command, for example a logic signal, for example an IMP binary signal illustrated in FIGS. 5*b* and 5*d*. Signal IMP is a function of the data to be printed. When only the downstream continuous stimulation signal with period Tb is generated, the logical value of the Boolean signal IMP remains 0. This is the constantly 0 signal which is illustrated in FIG. 5*b*.

In the printing situation, the IMP signal switches to the value 1 during at least one period Tb, triggering the response of the electrical control signal generator 32: thus, according to the preferred embodiment of the invention, the generator 32 of signals for controlling the stimulation means 31 is able to combine a signal with a pulse nature and a periodic signal, by replacing an integral number n of periods of the periodic signal with the pulse signal flanked with transition signals.

Figure 6:
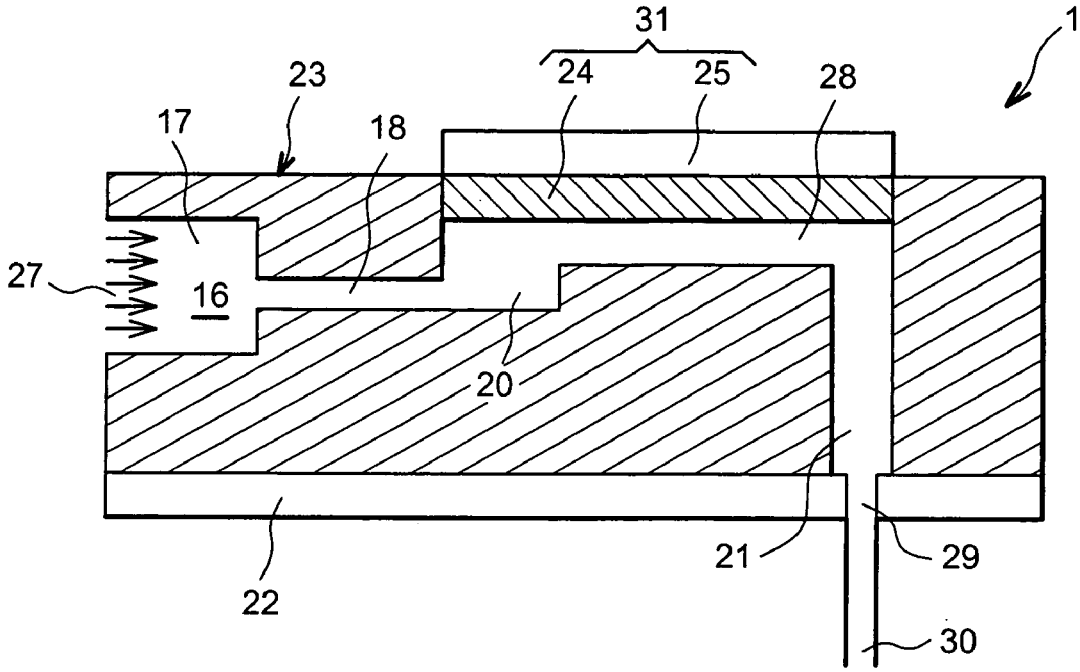
FIG. 6 is an example of a section of a printing head showing the part of the ink in a body of this head.
Figure 7:
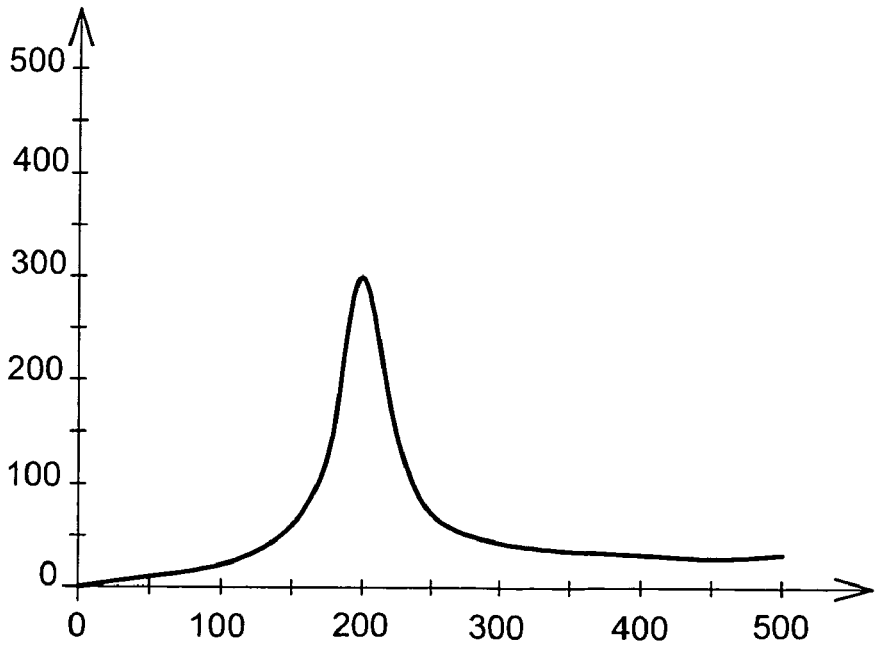
FIG. 7 is a graph showing the transfer function of an exemplary stimulation system. It includes in abscissae, the velocity perturbation locally provided to the jet depending on the frequency of a mechanical stimulation present in the ink circuit upstream from the nozzle.

Enhancements which may be made to the printing head according to the invention will now be examined in connection with FIGS. 6 and 7, which respectively illustrate an example of a section of a printing head 1 showing the path of the ink in a body 23 of this head and a graph showing in abscissae the velocity perturbation locally brought to the jet depending on the frequency of a mechanical stimulation present in the ink circuit upstream from the nozzle.

The hydraulic path inside the body 23 of the printing head 1 illustrated as a sectional view in FIG. 6 along one or more xz planes, z being the direction of the jet 30 and x a direction perpendicular to z located in a plane perpendicular to the plane containing the axes of the nozzles 29, includes from upstream to downstream discrete functional components in the direction of flow of the ink. A reservoir 17 of pressurized ink 16 is in communication, as illustrated by arrows 27, with an ink feeding conduit not shown. The reservoir 17 is in communication with a narrow passage 18 called a restrictor. A first connecting tube 20 puts the restrictor 18 into communication with the stimulation chamber 28. The stimulation chamber 28 is itself in communication with the nozzle 29 for forming the jet 30, via a second connecting tube 21. The nozzle 29 is pierced in a nozzle plate 22 which may include several nozzles aligned along a direction y perpendicular to the representation plane xz.

A wall portion of the chamber 28 is formed by a membrane 24, the thickness of which, along the Z axis, is much smaller than its dimensions in the X,Y planes. A piezoelectric component 25 is stuck on the external face of the membrane 24, i.e., the one which is external to the chamber 28.

When an electrical signal is applied on the piezoelectric component 25, the pair membrane 24/piezoelectric component 25 which forms in this example the stimulation means 31, forms a vibrating component 31 which deforms in flexion with the effect of producing a modulation of the volume and pressure within the chamber 28; this results in a modulation of the average ejection velocity of the ink 16 at the nozzle 29. This type of actuator which is described in many patents was initially proposed by Silonics (U.S. Pat. No. 3,946,398—Kyser & Sears).

The requirement of forming an isolated drop in a jet by applying an intermittent signal, as described in FIG. 4 portion a or b, and preferably avoiding the formation of satellite droplets such as 53, 54 described in connection with FIG. 3, as well as the formation of a train of drops behind the isolated drop, requires that the stimulation be strictly non-resonant. This means that the transfer function of the stimulation system should be free of any resonance peaks in the bandwidth of the jet 30. The transfer function of the stimulation system is defined as the relationship existing between the pressure induced by the action of the piezoelectric component 25 and the modulation of the ejection velocity of the jet 30.

The definition of the bandwidth $BP_{jet}$ of the jet 30 is derived from the linear theory of capillary instability, the skilled practitioner will know how to recall the following relationship:

$$BP_{jet} \in [0; Fc_{jet}] \qquad Fc_{jet} = \frac{V_{jet}}{2\pi R_{jet}}$$

For the numerical application:

Vjet: velocity of jet 30, for example 15 m/s

Rjet: radius of the jet at the nozzle output 29, for example 15 μm.

Fcjet=cut-off frequency of the jet, for example 160 kHz.

The stimulation system is capable of producing resonance frequencies $F_R$ related to the mechanical and acoustic behavior of the device. In order to obtain a strictly non-resonant stimulation, one will seek to place these resonance frequencies $F_R$ outside the bandwidth of the jet. Preferentially, the following relationship will be satisfied:

$$F_R > (1+0.1)\, Fc_{jet}$$

For this, one will strive to comply with one or several of the design rules hereafter.

Resonance of Mechanical and Acoustic Origin (Design Rule No. 1)

The vibrating component has a resonance eigenfrequency $F_M$ which mainly depends on its geometry and on the mechanical properties of the materials which compose it.

$$F_M = \frac{1}{2\pi\sqrt{L_M * C_M)}}$$

$L_M$: an inertial term equivalent to an inductor in an electric analogy.

$C_M$: an elasticity term equivalent to a capacitor in an electric analogy.

With the nominal values indicated in a dimension and material table subject of annex 1, the resonance frequency of the vibrating component 31 is typically of the order of 400 kHz.

In the absence of any propagation phenomenon, the Helmholtz frequency $F_H$ calculated from the inertial and elasticity terms (electric analogy) of each discrete component forming the simulation device, i.e., the restrictor, the chamber and the nozzle as well as the hydraulic connecting components between these components if they exist, will be of interest.

With the nominal values indicated in the dimension and material table, the Helmholtz resonance frequency which is typically of the order of 200 kHz is located outside the bandwidth of the jet. In the particular case of the values proposed in the table subject of annex 1, the Helmholtz frequency $F_H$ is calculated from the following simplified expression which only retains terms with preponderant weights:

$$F_H = \frac{1}{2\pi\sqrt{\left(\frac{L_B L_R}{L_B + L_R}\right) * C_M}}$$

$L_R$: inertial term (electric analogy) associated with the restrictor 18.

$L_B$: inertial term (electric analogy) associated with the nozzle 29.

$C_M$: elasticity term in the electric analogy of the vibrating component 31.

Acoustic Resonance with Propagation (Design Rule No. 2)

Acoustic propagation phenomena may produce resonance peaks when one of the characteristic wavelengths of the stimulation system is not insignificant relatively to the wavelength λ of the acoustic waves in the ink 16. As an example, the wavelength λ is typically 7.5 mm in an ink based on water, MEK or alcohol for a 160 kHz cut-off frequency of the jet $Fc_{jet}$ and for an average sound velocity, for example in MEK, of 1,200 m/s. A characteristic length means any dimension of the restrictor 18, of the chamber 28, of the first and second connecting tubes 20, 21, of the nozzle 29 and of the total path of the ink 16 in the stimulation system from the inlet of the restrictor 18 to the outlet of the nozzle 29. Ideally, all the characteristic lengths of the stimulation system will be less than λ/4 in order to be rid of acoustic wave propagation. The λ/4 constraint sets the maximum characteristic length to 1.8 mm. Generally, it is easy to satisfy the λ/4 constraint for the nozzle 29, the restrictor 18 and the connecting tubes 20, 21, as indicated in the appended dimension and material table. For the chamber 28, this rule may not be observed, as a large surface of the chamber is sought after in order to obtain proper stimulation efficiency, in this case, it is absolutely necessary to proceed with modeling of the transfer function in order to ensure that there is no resonance in the bandwidth of the jet.

For a stimulation system including the nominal dimensions indicated in the dimension and material table, it appears that its transfer function, the curve of which is shown in FIG. 7, does not have any resonant frequency in the bandwidth of the jet, a resonance peak 26 at 200 kHz associated with the Helmholtz frequency.

For a 160 kHz cut-off frequency of the jet and for a stimulation system with the indicated dimensions in the table of annex 1, the first resonance is located around 200 kHz which meets the listed criteria and precautions, it is easily to check that the stimulation is not resonant and so it is possible to advantageously form a drop in a continuous jet (FIGS. 6 and 7).

Optimization of the Stationary and Unstationary Flow (Design Rule No. 4).

Under the effect of the piezoelectric component 25, a pressure pulse pushes ink 16 towards the nozzle 29 and pushes ink 16 back towards the restrictor 18, indeed both of these two components form, for the chamber 28, the two output points of the ink 16. In order to maximize the efficiency of the stimulation, i.e., the velocity modulation at nozzle 29, it is desirable to match the impedance of the nozzle 29 to that of the restrictor 18 which has high acoustic impedance. The yield of the stimulation will be defined by the ratio $R_{imp}$ of the impedances $L_B$ of the nozzle and $L_R$ of the restrictor 18:

$$R_{imp} = \frac{L_R}{L_B} = \frac{l_R}{S_R}\frac{S_B}{l_B}$$

In the above formula:

$l_R$: length of the restrictor 18

$l_B$: length of the nozzle 29 in the Z direction $S_R$: cross section of the restrictor 18

$S_B$: cross section of the nozzle 29

With the idea of maximizing $R_{imp}$, the intuitive solution which would consist of selecting $l_R >> l_B$ and $S_R << S_B$ is of no interest as it requires a too large pressure of ink in the reservoir 17. Indeed, the formation of the continuous jet 30 requires a static ink pressure upstream from the restrictor 18 which strongly depends on the viscous pressure drops in the stimulation system and in particular in the nozzle 29 and the restrictor 18 which are the two areas with the higher flow velocity of the ink. The hydraulic resistance of the nozzle 29 or of the restrictor 18 is described, in a first approximation, by Poiseuille's law according to the following generic expression:

$$\frac{\Delta P}{Q} = R_{Hydro} = \frac{8\ \mu l}{\pi R^4}$$

ΔP: static pressure drop between the inlet and outlet of the nozzle 29 or of the restrictor 18

Q: volume flow rate

R: radius of the nozzle 29 or of the restrictor 18 l: length of the nozzle 29 or of the restrictor 18,

μ: is the dynamic viscosity of the ink.

In order to reduce the hydraulic resistance of the restrictor 18 comparatively to the nozzle 29 and while retaining a good stimulation yield, one will act on the equivalence [length←→section] by preferring a section and a length of the restrictor 18 larger than that of the nozzle 29. The nominal dimensions indicated in the dimension and material table of annex 1, are a good compromise between the stimulation yield and the viscous pressure drop. For nozzle 29 and restrictor 18 radius, respectively length, ratios of typically 1/3, respectively 1/10, one obtains:

$$\begin{cases} R_{Imp} \cong 1 \\ R_{Hydro}(\text{restrictor}) \cong \frac{1}{10} R_{Hydro}(\text{nozzle}) \end{cases}$$

The volume contained in the chamber 28 with a parallelepipedous shape is selected so that the Helmholtz frequency of the system is not less than 200 kHz. The thickness of the chamber (in the Z direction) should be as small as possible in order to provide a maximum surface to the vibrating component 31 but nevertheless not less than the diameter of the nozzle 29 in order to minimize the viscous pressure drop in the chamber 28. This thickness which results from a compromise, will be selected so as to be close to the diameter of the nozzle 29. As the volume and thickness are given, this sets the surface of the chamber while ensuring good consistence with design rule No. 1.

Thus, a printer according to the invention includes:

a device for ejecting liquid with which at least one ink jet may be formed, a generator of electrical control signals, an internal stimulation device, i.e., upstream from the nozzle, with which the jet may be fractionated by creating perturbations at its surface at the output of the nozzle. This stimulation device is capable of generating an isolated drop in the jet when the suitable pulse signal is applied on the stimulation means, a sorting system consisting of an arrangement of electrodes brought to constant electric potentials and of a trough which collects the unprinted drops.

With the invention, it is possible to use a common sorting system for a large number of jets, which eliminates the difficulties in the manufacture of charging electrodes of a conventional binary printer, and to make the most of the advantageous of the sorting system with intermittent stimulation, notably its low manufacturing cost. Further, as the stimulation is internal, the problems of bulkiness and difficulties related to external stimulation techniques are eliminated. With the stimulation device driven according to the principle of the invention, it is also possible to change the behaviour of the jet and trajectory of the drops by the sole means of the stimulation signal, which simplifies the electronic portion of the printing head and provides very fine control over the stability of the jet and the printing quality. The combination of two stable breaks also contributes to controlling the two trajectories of the two types of drops created by simple adjustment of the stimulation signal parameters, which contribute to enhancing the reliability of the machine and the printing quality.

It will be noted that a printing head using the invention may either comprise or not the circuit 32 for generating break-up signals.

ANNEX 1

Dimension and material table

| Function | Length (X)/ Width (Y)/radius | Thickness (Z) | Materials |
|---|---|---|---|
| Restrictor 18 | 250 μm/130 μm/— | 38 μm | Inox 316 |
| Connecting tube 20 | —/—/75 μm | 38 μm | Inox 316 |
| Chamber 29 | 1000 μm/410 μm/— | 38 μm | Inox 316 |
| Vibrating | 1000 μm/410 μm/— | 125 μm | PZT |
| component 31: - piezoceramic-membrane | 1000 μm/410 μm/— | 62.5 μm | Inox 316 |
| Connecting tube 21 | —/—/50 μm | 475 μm | Inox 316 |
| Nozzle 29 | —/—/15 μm | 50 μm | Inox 316 |

Inox: Stainless steel

ANNEX 2

List of cited documents

US-A-4,220,958 CROWLEY
US-A-3,596,275 SWEET
US-A-4 638,328 BRAKE ET AL.
FR 2 799 688 → 09/685,064
Journal Xerox Disclosure (Pincus - 1982, vol. 7, p. 23).

The invention claimed is:

1. An ink jet printer comprising:

a generator of electrical control signals configured to receive a control signal and deliver stimulation signals to a stimulation device;

a printing head having a body including at least one printing nozzle;

a hydraulic path of the ink including, a stimulation chamber in hydraulic communication with the printing nozzle and configured to emit a pressurized ink jet along an axis of the printing nozzle;

the stimulation device mechanically coupled with ink in the stimulation chamber and configured to stimulate the ink jet emitted by the printing nozzle and to break up the ink jet in a controlled way;

an ink recovering section configured to recover ink which is not received by a printing substrate;

charging electrodes, including upstream electrodes in an upstream area along the axis of the printing nozzle and downstream electrodes in a downstream area along the axis of the printing nozzle, the downstream area being further away from the printing nozzle than the upstream area, upstream and downstream electrodes being connected to different sources of electric potential to maintain in one of the upstream and downstream areas, a first potential equal to a body potential of an ink found in the body of the printing head, and to maintain in the other one of the upstream and downstream areas a second potential different from the body potential of the ink found in the body of the printing head; and deflection electrodes axially located downstream from the charging electrodes, wherein the generator of electrical control signals is further configured to deliver the stimulation signals to intermittently cause controlled breaking up of the ink jet to intermittently form a drop in an upstream breaking position located in the upstream area, thereby separating the ink jet into a drop and a jet section having a length larger than two wavelengths of the ink jet, and configured to cause controlled breaking up of the ink jet or of sections of the ink jet continuously in a downstream breaking position located in the downstream area, the ink jet emitted by the nozzle being thereby transformed after the downstream area into a continuous train of electrically charged and uncharged ink drops.

2. The printer according to claim 1, wherein the upstream electrode is connected to the same potential as the ink.

3. The printer according to claim 2, wherein the stimulation device includes a piezoelectric material, the generator of electrical control signals further configured to deliver to the stimulation device a continuous printing signal formed by a periodic signal of period $T_b$, intermittently replaced with a pulse signal preceded and followed by transition signals.

4. The printer according to claim 3, wherein the pulse signal delivered by the generator of electrical control signals is formed by a pulse including three consecutive voltage steps connected from one to the next by a steep rising or falling voltage edge.

5. The printer according to claim 3, wherein the pulse signal delivered by the generator of electrical control signals is formed by a succession of three rectangular pulses separated from each other by voltage steps with a level less than the level of the pulse with the lowest level.

6. The printer according to claim 1, wherein the stimulation device includes a piezoelectric material, the generator of electrical control signals further configured to deliver to the stimulation device a continuous printing signal formed by a periodic signal of period $T_b$, intermittently replaced with a pulse signal preceded and followed by transition signals.

7. The printer according to claim 6, wherein the pulse signal delivered by the generator of electrical control signals is formed by a pulse including three consecutive voltage steps connected from one to the next by a steep rising or falling voltage edge.

8. The printer according to claim 6, wherein the pulse signal delivered by the generator of electrical control signals is formed by a succession of three rectangular pulses separated from each other by voltage steps with a level less than the level of the pulse with the lowest level.

9. The printer according to any of claims 6–8 or 3–5, wherein the periodic signal delivered by the generator of electrical control signals is formed by a combination of two sinusoidal signals.

10. The printer according to any of claims 6–8 or 3–5, wherein the periodic signal delivered by the generator of electrical control signals is formed by a combination of more than two sinusoidal signals.

11. The printer according to any of claims 6–8 or 3–5, wherein the sum of the durations of the pulse signal and of the transition signals delivered by the generator of electrical control signals is equal to an integral number of periods of the periodic signal.

12. The printer according to any of claims 3–8 or 3–5, wherein the stimulation device further comprises a membrane mechanically coupled with the piezoelectric material, wherein a resonance frequency of a vibrating component formed by the membrane and the piezoelectric material is larger than a cut-off frequency of the jet.

13. A method for printing a medium using a printer according to any of claims 6–8 or 3–5, comprising steps of:

intermittently fractionating an ink jet emitted by a nozzle of the printer to form intermittent drops for printing and jet sections with a length larger than two wavelengths of the jet in an upstream position, and further fractionating recovered drops in a downstream position from the intermittent drops for printing or the jet sections;

directing recovered drops towards a recovery trough; and impinging a printing substrate with the first drops to form points on the medium.

14. The printer according to any of claims 1–8 or 3–5, wherein a Helmholtz frequency of a portion of a hydraulic path of the ink feeding a nozzle comprising a restrictor and the portion located downstream from the restrictor has a value located outside a bandwidth of the jet issued from the nozzle.

15. The printer according to any of claims 1–8 or 3–5, wherein the hydraulic path of the ink includes a restrictor and a length of a portion of the hydraulic path between an inlet of the restrictor and the nozzle is less than the quarter of the wavelength of sound in the ink.

16. The printer according to any of claims 1–8 or 3–5, wherein the stimulation device is strictly non-resonant.

17. An ink jet printer comprising:

at least one printing nozzle;

a hydraulic path of the ink including a stimulation chamber in hydraulic communication with the printing nozzle and configured to emit a pressurized ink jet along an axis of the printing nozzle;

the stimulation device mechanically coupled with ink in the stimulation chamber and configured to stimulate the ink jet emitted by the printing nozzle and to break up the ink jet in a controlled way;

an ink recovering section configured to recover ink which is not received by a printing substrate;

a generator of electrical control signals configured to receive a control signal and deliver stimulation signals to the stimulation device;

charging electrodes including upstream electrodes in an upstream area along the axis of the printing nozzle and downstream electrodes in a downstream area along the axis of the printing nozzle, the downstream area being further away from the printing nozzle than the upstream area, upstream and downstream electrodes being connected to different sources of electric potential to maintain in one of the upstream and downstream areas a first potential equal to a body potential of an ink found in the body of the printing head, and to maintain in the other one of the upstream and downstream areas, a second potential different from the body potential of the ink found in the body of the printing head; and deflection electrodes axially located downstream from the charging electrodes wherein the generator of electrical control signals is further configured to deliver the stimulation signals to intermittently cause controlled breaking up of the ink jet to intermittently form a drop in an upstream breaking position located in the upstream area, thereby generating first intermittent drops intended for printing, and jet sections having a length larger than two wavelengths of the ink jet, and configured to cause controlled breaking up of the ink jet or of the sections of the ink jet continuously in a downstream breaking position located in the downstream area, the ink jet emitted by the nozzle being thereby transformed after the downstream area into a continuous train of electrically charged and uncharged ink drops.

18. The printer head according to claim 17, wherein the upstream electrode is connected to the same potential as the ink.

19. The printer head according to claim 18, wherein the stimulation device includes a piezoelectric material, the generator of electrical control signals further configured to deliver to the stimulation device, a continuous printing signal formed by a periodic signal with period $T_b$, intermittently replaced with a pulse signal preceded and followed by transition signals.

20. The printer head according to claim 19, wherein the pulse signal delivered by the generator of electrical control signals is formed by a pulse including three consecutive voltage steps connected from one to the next by a steep rising or falling voltage edge.

21. The printer head according to claim 19, wherein the pulse signal delivered by the generator of electrical control signals is formed by a succession of three rectangular pulses separated from each other by voltage steps with a level less than the level of the pulse with the lowest level.

22. The printer head according to claim 17, wherein the stimulation device includes a piezoelectric material, the generator of electrical control signals further configured to deliver to the stimulation device, a continuous printing signal formed by a periodic signal with period $T_b$, intermittently replaced with a pulse signal preceded and followed by transition signals.

23. The printer head according to claim 22, wherein the pulse signal delivered by the generator of electrical control signals is formed by a pulse including three consecutive voltage steps connected from one to the next by a steep rising or falling voltage edge.

24. The printer head according to claim 22, wherein the pulse signal delivered by the generator of electrical control signals is formed by a succession of three rectangular pulses separated from each other by voltage steps with a level less than the level of the pulse with the lowest level.

25. The printer head according to any of claims 22 to 24, wherein the periodic signal delivered by the generator of electrical control signals is formed by a combination of two sinusoidal signals.

26. The printer head according to any of claims 22 to 24, wherein the periodic signal delivered by the generator of electrical control signals is formed by a combination of more than two sinusoidal signals.

27. The printer head according to any of claims 22 to 24, wherein the sum of the durations of the pulse signal and the transition signals delivered by the generator of electrical control signals is equal to an integral number of periods of the periodic signal.

28. The printer head according to any of claims 22 to 24, wherein the stimulation device further comprises a membrane mechanically coupled with the piezoelectric material, a resonance frequency of a vibrating component formed by the membrane and the piezoelectric material has a value located outside a bandwidth of the jet.

29. The printer head according to any of claims 17 to 24, wherein a Helmholtz frequency of a portion of a hydraulic path of the ink feeding a nozzle comprising a restrictor and the portion located downstream from the restrictor, has a value located outside a bandwidth of the jet issued from the nozzle.

30. The printer head according to any of claims 17 to 24, wherein the hydraulic path of the ink includes a restrictor and a length of a portion of the hydraulic path between an inlet of the restrictor and the nozzle is less than the quarter of the wavelength of sound in the ink.

31. The printer head according to any of claims 17 to 24, wherein the stimulation device is strictly non-resonant.

* * * * *